US005263470A

United States Patent [19]

Whitehouse

[11] Patent Number: 5,263,470

[45] Date of Patent: Nov. 23, 1993

[54] METHOD AND APPARATUS FOR USE IN INSTALLING A FIREBOX IN A FIREPLACE IN CONNECTION WITH A FLUE LINER

[75] Inventor: Donald Whitehouse, Birmingham, England

[73] Assignee: Valor Limited, England

[21] Appl. No.: 918,418

[22] Filed: Jul. 22, 1992

[30] Foreign Application Priority Data

Jul. 23, 1991 [GB] United Kingdom ..... 9115858

[51] Int. Cl.[5] ..... F24C 15/30

[52] U.S. Cl. ..... 126/500; 126/315; 126/318

[58] Field of Search ..... 126/315, 316, 318, 312, 126/307 R, 307 A, 82, 500

[56] References Cited

U.S. PATENT DOCUMENTS 1,278,895 9/1918 Farley ..... 126/315
4,766,882 8/1988 Schinbeckler ..... 126/500
4,924,850 5/1990 Rieger ..... 126/315

*Primary Examiner*—James C. Yeung
*Attorney, Agent, or Firm*—Bernard L. Kleinke; Jerry R. Potts

[57] ABSTRACT

The present invention relates to a method and apparatus for use in installing a gas fire in a fireplace. The apparatus comprises an adaptor member in the form of a planar plate from which a flue spigot projects upwardly, the flue spigot in use, being connected with a flue liner. The planar plate has a rearward end section which is interengageable with a rearward part of the fire whereby the planar plate can subsequently be pivoted to a position wherein a front section of the planar plate can be secured to the fire. Said rearward end section and said front section of the planar plate are thus secured to the fire, holding the planar adaptor member flat against the upper surface of the fire with the flue spigot aligned with a flue passage in the fire.

13 Claims, 3 Drawing Sheets

METHOD AND APPARATUS FOR USE IN INSTALLING A FIREBOX IN A FIREPLACE IN CONNECTION WITH A FLUE LINER

DESCRIPTION

The present invention relates to a method and apparatus for use in installing a firebox in a fireplace in connection with a flue liner.

In particular the present invention relates to a method and apparatus for use in installing a gas firebox in a fireplace. Certain known gas fireboxes have a flue spigot which projects generally upwardly from the rear region of the upper surface of the gas firebox. During installation the gas firebox is moved rearwardly into the fireplace until the flue spigot is nearly underneath the flue liner which extends up the flue/chimney. The flue liner is then flexed and/or moved generally vertically and located over the flue spigot and a clamp such as a jubilee clip is used to tighten the liner around the spigot. The gas firebox can then be moved the final small distance to the fully installed position. As will be appreciated there must be a considerable amount of space available between at least the upper surface of the gas firebox and the top of the fireplace opening to both allow the upstanding spigot to move with the gas firebox into the fireplace opening and to allow the arms and hands of the person installing the firebox to reach the spigot to make and tighten the connection between the spigot and liner. Such a large clearance has to be aesthetically closed in the completed installation and sometimes the size of the gas firebox is optimised requiring the gas fire to be a relatively close fit in the fireplace opening. In the latter case an adaptor such as disclosed in U.S. Pat. No. 4,924,850 can be used to simplify the connection with the flue liner. The adaptor of U.S. Pat. No. 4,924,850 comprises a generally rectangular planar plate from one end region of which a cylindrical flue spigot projects. In use the spigot is first secured to the flue liner and then as the firebox is introduced into the fireplace opening and moved rearwardly, the planar plate is engaged in and slid along elongate guides provided in the upper surface of the firebox. When the gas firebox attains its fully installed position the planar plate or a projection thereof can be secured to the body of the gas firebox, the spigot then being aligned with a flue passage in the gas firebox, which flue passage opens in the upper surface of the firebox between said elongate guides. Due to manufacturing tolerances the planar plate can be a relatively loose fit in the elongate guides and thus combusted gases may be able to escape into the fireplace opening and thus through the front of the firebox, rather than pass into the flue liner. Also during installation, the planar plate may become angled to the elongate guides and jammed in the guides, thus hampering and delaying the completion of installation.

The aim of the present invention is to provide an improved method and apparatus for installing a firebox in a fireplace opening, which provides a close fit with the body of the gas firebox whereby the firebox can be simply though efficiently connected with a flue liner.

According to the present invention there is provided an apparatus for use in installing a firebox in a fireplace opening comprising an adaptor, part of which forms a flue spigot which, in use, can be connected with a flue liner, the adaptor member having a section which is engageable with part of the body of a firebox whereby the adaptor can be subsequently pivoted to a position wherein the adaptor member can be secured flat against the upper surface of the firebox with the flue spigot aligned with a flue passage in the body of the firebox.

In a preferred embodiment of the present invention the adaptor member comprises a rectangular planar plate with a cylindrical flue spigot projecting upwardly therefrom. In use the flue spigot is secured to a flue liner by a clamp such as a jubilee clip. The gas firebox is then located in the fireplace opening and moved rearwardly until the spigot of the adaptor member is substantially over a flue passage in the body of the gas firebox, the adaptor member and flue liner being pushed upwards slightly to allow the firebox to enter the fireplace opening easily. By pulling the adaptor member downwards and forwards, and tilting the planar plate, a section of the adaptor member in the form of a tongue provided on the rear end edge region of the planar plate, can be engaged in an opening in an upstanding flange provided at the rear of the upper surface of the body of the firebox. The planar plate is then effectively pivoted down into engagement with the upper surface of the body of the firebox, the tongue and aperture being preferably tapered to hold the rear end region of the adaptor member in this position. The other end region of the planar plate can then be secured, e.g. screwed, to the front region of the upper surface of the gas firebox, thus securing the planar plate tightly and closely to the upper surface of the firebox. If required a gasket may be provided between the planar plate and the upper surface of the gas firebox around the aligned flue passage/flue spigot connection to further seal the planar plate to the upper surface of the firebox. Thus a simple positive connection is achieved.

As opposed to providing the tongue in the planar plate and an aperture in a flange of the gas firebox, the converse or any other suitable male/female interconnection may be provided between the rear end region of the adaptor member and the gas fire body. For example, the rear end region of the planar plate may have a downwardly and forwardly projecting tongue which can be engaged in an aperture in the rear face of the gas firebox.

According to a further aspect of the present invention there is provided a method of installing a firebox in a fireplace opening comprising the steps of providing an adaptor member, part of which takes the form of a flue spigot, connecting the flue spigot with a flue liner, locating the firebox in a position wherein a flue passage opening in the upper surface of the gas firebox is located generally under the flue spigot, moving the adaptor member towards the front of the firebox and engaging a rearward part of the adaptor member with part of the body of the firebox, effectively pivoting the adaptor member to a position wherein the adaptor member is flat against the upper surface of the firebox with the flue spigot aligned with the flue passage, and securing the forward region of the adaptor member to the body of the firebox. If required a gasket may be provided between the adaptor member and the upper surface of the firebox to further seal the adaptor member to the body of the firebox to ensure that all of the combusted gases flowing along the flue passage enter the flue liner.

The present invention will now be further described, by way of example, with reference to the accompanying drawings, in which.

Figure 1:
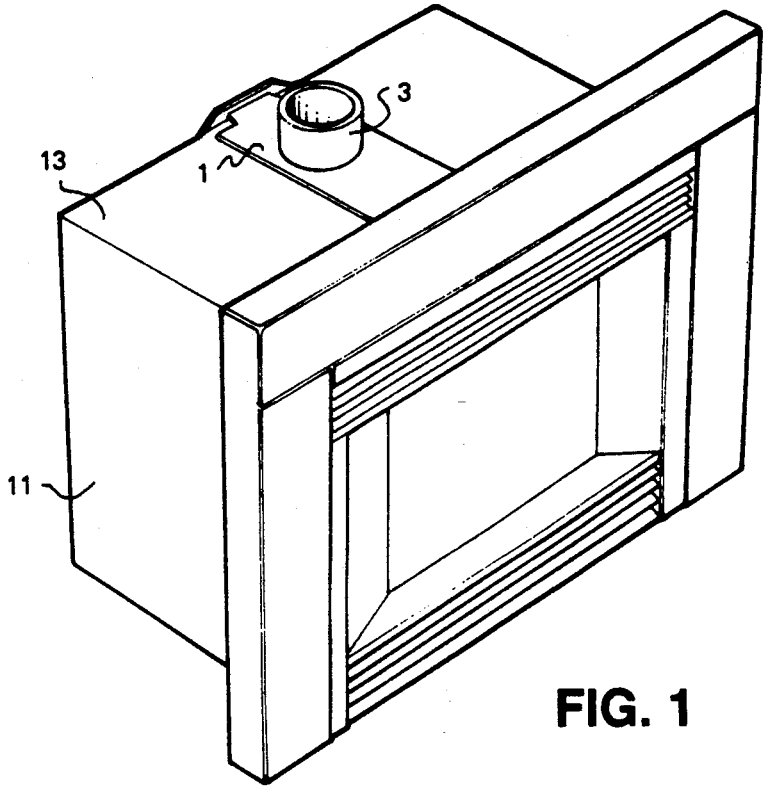
FIG. 1 is a perspective view of a firebox suitable for incorporating the apparatus of the present invention.
Figure 2:
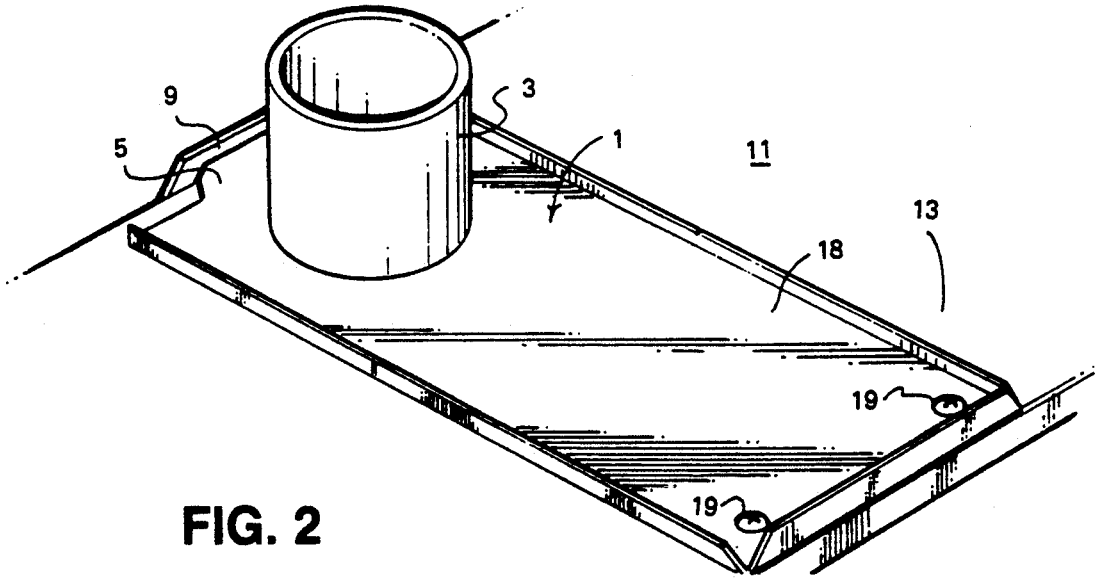
FIG. 2 is an enlarged perspective view of part of the upper surface of the firebox of FIG. 1, incorporating one embodiment of the present invention.

A preferred embodiment of the present invention is illustrated in the accompanying drawings, and comprises an adaptor member in the form of a planar plate 1 of generally rectangular configuration. A cylindrical flue spigot 3 projects upwardly from one end region of the planar plate 1, and opens through the planar plate 1. The end edge section of the planar plate 1 nearest to the flue spigot 3 is formed as a tongue 5—see FIG. 3,—which can be engaged in a slot 7 formed by an upstanding flange 9 provided at the rear of a gas fire body or firebox 11, the lower edge of the slot 7 being formed by the upper surface 13 of the gas fire body.

Figure 3:
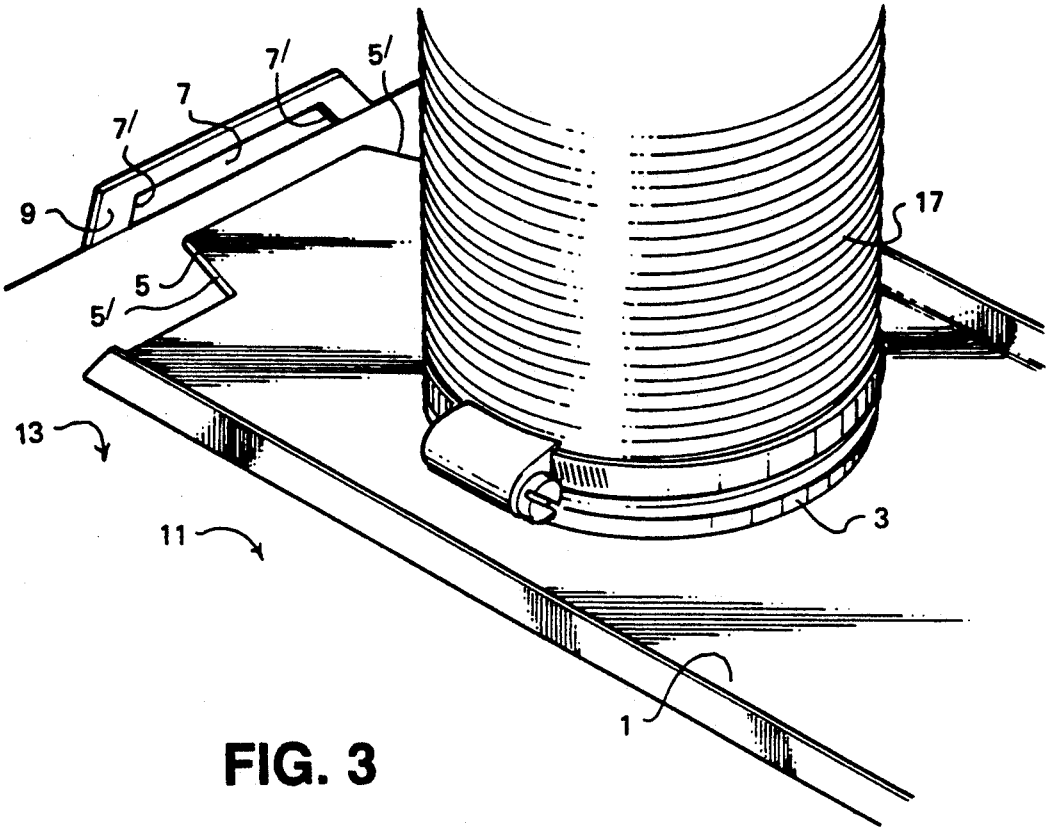
FIG. 3 is a further enlarged view of part of the upper surface shown in FIG. 2, illustrating the assembly of the apparatus of the present invention.
Figure 4:
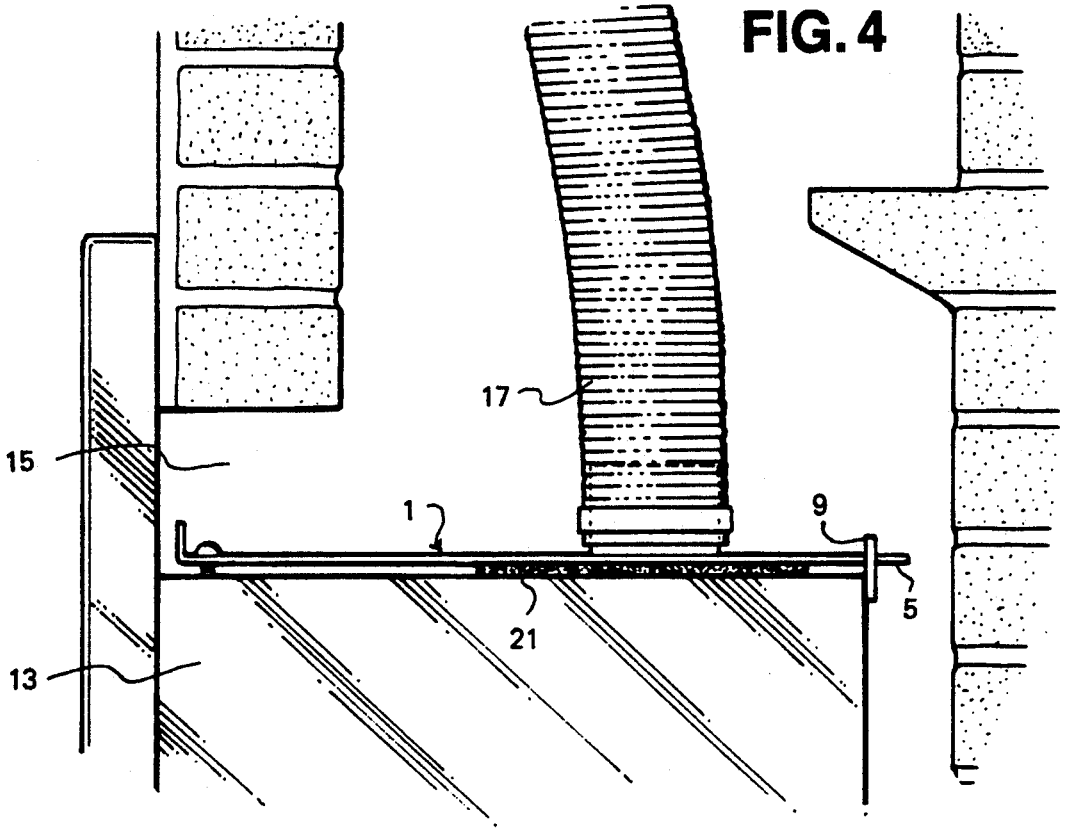
FIG. 4 is a schematic cross-sectional view of the firebox of FIGS. 1 and 2, installed in a fireplace opening and connected with a flue liner.

In use, as best seen in FIG. 4, the adaptor member 1 is first located in a fireplace opening 15 with the flue spigot 3 located over and secured to the end region of a flue liner 17. The gas fire body 11 is then moved rearwardly into the fireplace opening 15, the flue liner 17 usually being flexible and having a limited amount of vertical movement available so that the adaptor member 1 can be pushed clear of the upstanding flange 9 at the rear of the gas fire body 11. With the gas fire body 11 virtually in the fully installed position, the planar plate 1 can be manually pulled from its other end edge region 18 which is adjacent the front of the firebody 11, so that the tongue 5 is located in front of the upstanding flange 9. With the planar plate 1 tilted slightly the tongue 5 can be slid along the upper surface 13 of the gas fire body 11 into the slot 7. Then the planar plate 1 can be pivoted downwards to lie flush along the upper surface 13 of the gas fire body. As best seen in FIG. 3 the tongue 5 has tapered side edges 5' and the slot 7 has tapered side edges 7' which interengage to force the tongue 5 and thus the planar plate 1 down against the upper surface 13 of the gas fire body 11, with the spigot 3 and thus the flue liner 17, coaxially aligned with the flue passage in the gas fire body 11. The planar plate 1 is secured in this gas-tight manner by the other end edge region of the planar plate 1, which is near to the front of the fire body 11, being secured to the gas fire body 11 by screws 19 which can be readily located and tightened from the front of the fire body 11.

To ensure a gas-tight seal between the planar plate 1 and the upper surface 13 around the aligned flue liner 17 and the flue passage in the gas fire body 11, a gasket 21 can be provided between the planar plate 1 and upper surface 13. In such a case the bottom edge of the slot 7 need not be flush with the upper surface 13.

Figure 5A:
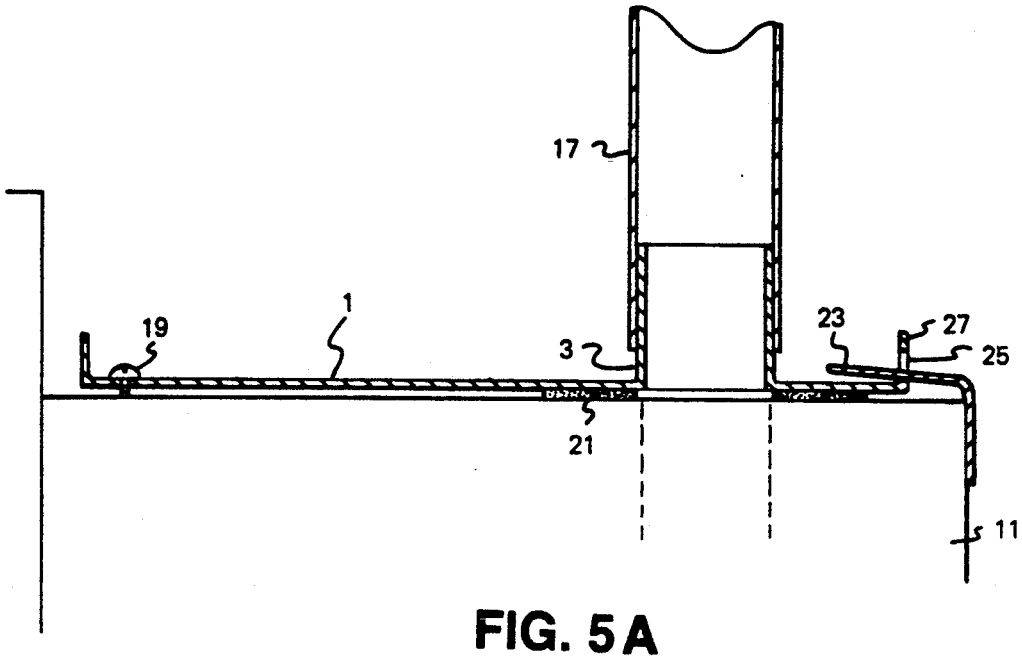
FIG. 5A is a side view of a further embodiment of the present invention.
Figure 5B:
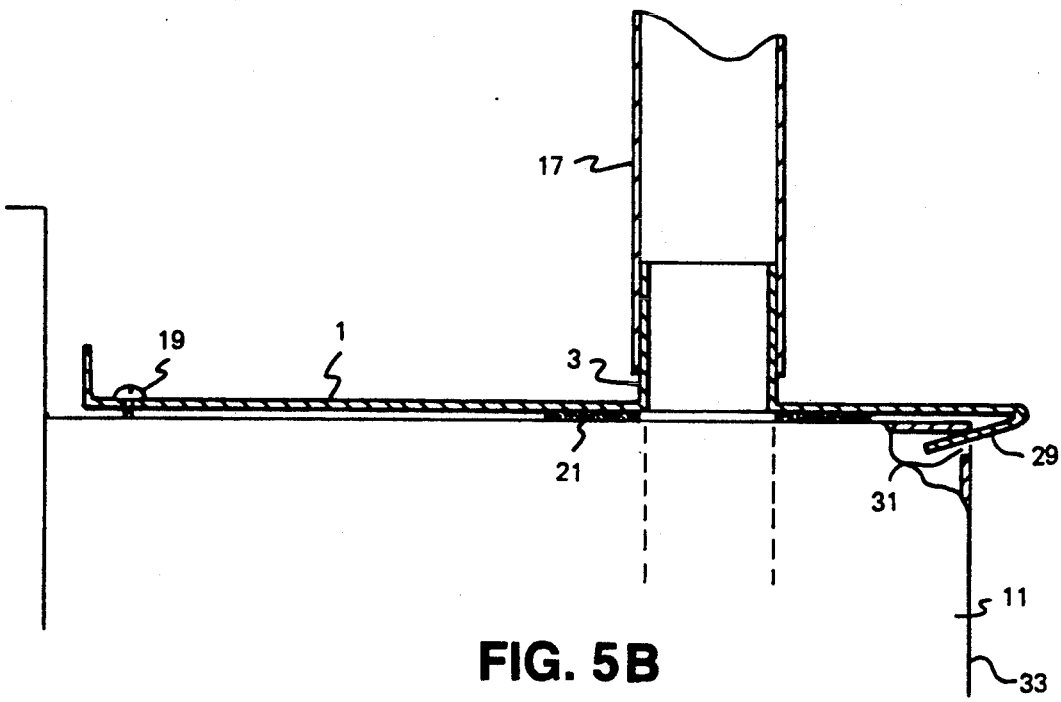
FIG. 5B is a side view of a still further embodiment of the present invention.

In a modified embodiment of the present invention, as shown in FIG. 5A of the accompanying drawings, a tongue 23 projects from the rear region of the gas fire body 11, and a complementary slot 25 is provided in an upstanding flange 27 of the planar plate 1. Otherwise this modified embodiment functions exactly as for the embodiment of FIGS. 1 to 4, described hereabove.

In a still further embodiment of the present invention the rear edge of the planar plate 1 is provided with a downwardly and forwardly projecting tongue 29 which, in use, engages in an aperture 31 provided in the rear face 33 of the gas fire body 11. To hold the rear end region of the planar plate 1 against the upper surface 13 of the gas fire body 11 the tongue 29 is angled so that the further it engages in the aperture 31 the tighter the planar plate engages the surface 13 or gasket 21.

As an alternative to the above described planar plate, planar tongue and slot configurations, the adaptor member can have any desired configuration, with any required male/female interengaging connection being provided to the rear of the upper part of the gas fire body.

The present invention thus provides a simple but efficient apparatus and method for use in connecting a gas fire body 11 to a flue liner, the apparatus being simply and positively installable without the possibility of the adaptor becoming jammed.

I claim:

1. An apparatus for use in a fireplace, said fireplace having a flue, a flue liner and a firebox with an upper surface having means defining a flue passage opening disposed therein, comprising:

an adaptor member having a flue spigot portion, said flue spigot portion for connecting removably to the flue liner;

slot means on one of the firebox and said adapter member having means defining a slot;

tongue means being disposed on the other one of the firebox and said adapter member and being dimensioned to be received within the slot when angularly disposed relative to the upper surface of the firebox and adapted to be interengageable with said slot when disposed in alignment with the upper surface of the firebox;

said slot having tapered side edges for enabling said tongue means to be received initially within said slot at a slightly tilted approach and to be received forcedly thereafter in a downwardly pivoted position; and said tongue means having tapered edges for helping to retain fixedly said adaptor member in a lush position on the upper surface of the firebox and for helping to align coaxially said flue spigot with said flue passage opening;

whereby, the adaptor member can be pivoted with said means defining a slot to cause said tapered edges to retain said adaptor member flat against the upper surface of the firebox with the flue spigot aligned with the flue passage in the firebox.

2. An apparatus according to claim 1, wherein said flue spigot portion includes a planar plate; and a cylindrical flue spigot, said flue spigot projecting upwardly from said plate.

3. An apparatus according to claim 2, wherein the planar plate is generally rectangular in shape.

4. An apparatus according to claim 2, wherein said planar plate is secured to the firebox by at least one screw.

5. An apparatus according to claim 1, wherein said tongue means includes a tongue for engaging and being received within said means defining a slot.

6. An apparatus according to claim 5, wherein the tongue has tapered lateral edges.

7. An apparatus according to claim 1, wherein the rear portion of the firebox further includes a raised forwardly projecting tongue; and wherein said flue spigot portion includes means defining an aperture for engagement with said raised forwardly projecting tongue.

8. An apparatus according to claim 1, wherein the rear portion of the firebox further includes a rear face having means defining an aperture; and wherein said flue spigot portion includes a downwardly and forwardly directed tongue said tongue adapted to be received within said means defining an aperture in the rear face of the firebox.

9. An apparatus according to claim 1, further comprising: a gasket mounted to said adaptor member for sealing the flue spigot within said means defining a flue passage opening.

10. A method of installing a firebox in a fireplace having a flue liner, said firebox having an opening, a rear portion, and an upper portion with a flue passage opening, comprising:

providing an adaptor member having tongue means for helping to retain said adaptor member within the firebox, and a flue spigot, said flue spigot adapted to be connected to the flue liner;

locating the flue passage opening of the firebox; generally under the flue spigot;

moving the adapter member towards the firebox and inter-engaging a rearward section of the adaptor member with an upstanding flange part of the firebox;

pivoting the adaptor member within said upstanding flange to cause said slot receiving means to retain said adapter member flat against the upper surface of the firebox with the flue spigot aligned with the flue passage.

11. A method according to claim 10, further comprising: sealing the flue spigot within the flue passage.

12. An apparatus for use in a fireplace, said fireplace having a flue, a flue liner and a firebox with an upper surface having means defining a flue passage opening disposed therein, comprising:

an adapter member having a flue spigot portion, said flue spigot portion for connecting removably to the flue liner;

slot means on said adapter member having means defining a slot;

tongue means being disposed on the firebox and being dimensioned to be received within the slot when disposed in alignment with the upper surface of the firebox and adapted to be interengageable with said slot;

said slot having tapered side edges for enabling said tongue means to be received initially within said slot at a slightly tilted approach and to be received forcedly thereafter in a substantially fully inserted resting position; and said tongue means having tapered edges and being upwardly forwardly inclined to the horizontal plane of the upper surface of the firebox for helping to retain fixedly said adaptor member in a substantially flush position on the upper surface of the firebox and for helping to align coaxially said flue spigot with said flue passage opening;

whereby, the adapter member can be received within said means defining a slot to cause said tapered side edges to retain said adaptor member flat against the upper surface of the firebox with the flue spigot aligned with the flue passage in the firebox.

13. An apparatus for use in a fireplace, said fireplace having a flue, a flue liner and a firebox with an upper surface having means defining a flue passage opening disposed and a rear portion with means defining a slot therein, comprising:

an adaptor member having a flue spigot portion, said flue spigot portion for connecting removably to the flue liner;

retaining means being disposed on said adapter member and being dimensioned to be received within the slot when said adaptor member is disposed in alignment with the upper surface of the firebox and adapted to be interengageable with said slot;

said slot having tapered side edges for enabling said hook means to be received initially within said slot a ta slightly tilted approach and to be received forcedly thereafter in a downwardly pivoted position; and said retaining means having tapered edges and including a downwardly forwardly directed tongue, said tongue being dimensioned to be received within the slot for helping to retain fixedly said adaptor member in a flush position on the upper surface of the firebox and for helping to align coaxially said flue spigot with said flue passage opening;

whereby, the adaptor member can be received within the slot to cause said tapered edges to retain said adaptor member flat against the upper surface of the firebox with the flue spigot aligned with the flue passage in the firebox.

* * * * *